US006168386B1

(12) United States Patent
Segers

(10) Patent No.: US 6,168,386 B1
(45) Date of Patent: Jan. 2, 2001

(54) DEVICE FOR INJECTING A LIQUID IN A COMPRESSED GAS

(75) Inventor: Karel Segers, Temse (BE)

(73) Assignee: Atlas Copco Airpower, naamloze vennootschap (BE)

( * ) Notice: Under 35 U.S.C. 154(b), the term of this patent shall be extended for 0 days.

(21) Appl. No.: 09/299,645

(22) Filed: Apr. 27, 1999

(30) Foreign Application Priority Data

Apr. 28, 1998 (BE) ..... 09800318

(51) Int. Cl.[7] ..... F04F 5/48
(52) U.S. Cl. ..... 417/151; 417/186
(58) Field of Search ..... 417/186, 190, 417/151

(56) References Cited

U.S. PATENT DOCUMENTS 4,131,658 12/1978 Hirata et al. .
4,395,201 * 7/1983 Bron ..... 417/169
4,476,827 10/1984 Basaglia et al. .

FOREIGN PATENT DOCUMENTS 1808849 7/1970 (DE) .
195 19 885 A1 12/1996 (DE) .
440682 * 1/1936 (GB) ..... 417/186
1338378 11/1973 (GB) .

* cited by examiner

*Primary Examiner*—John Fox
(74) *Attorney, Agent, or Firm*—Bacon & Thomas PLLC

(57) ABSTRACT

A device for injecting a liquid in a compressed gas contains a reservoir for the liquid, sealed by means of a cover which is provided with a passage for the gas in which opens a liquid channel which is connected to the reservoir. The passage is arranged with a jet pipe in the vacuous part from where the liquid channel discharges. The passage, seen in the flow direction, is divided in two separate gas channels by means of a wall, extending from before the place where the liquid enters the passage up to the end of this passage, such that the liquid only enters in one of the two gas channels.

9 Claims, 4 Drawing Sheets

DEVICE FOR INJECTING A LIQUID IN A COMPRESSED GAS

BACKGROUND OF THE INVENTION

1. Field of the invention

The present invention concerns a device for injecting a liquid in a compressed gas, which device contains a reservoir for the liquid, sealed by means of a cover which is provided with a passage for the gas in which opens a liquid channel which is connected to the reservoir, whereby the passage forms or contains a jet pipe in the vacuous part from where the liquid channel discharges.

When gas under pressure flows through the passage, an a suction is created in the jet pipe, i.e. a narrowing/widening tube, also called venturi tube, where the constriction or throat is situated, so that liquid is sucked out of the cistern via the liquid channel and injected in the gas.

The passage is connected to a source of gas under pressure with its inlet and it is connected to at least two pipes with its outlet, for example via a nozzle having at least two branches which can usually all be shut off by means of a closure valve.

When driving pneumatic machines, it is usually advisable to add lubricating oil to the compressed air. That is why devices of the above-mentioned type, known as line lubricators, are placed between the compressed air receiver and a nozzle into which the various compressed air lines are connected.

2. Discussion of the Related Art

In the known line lubricators, compressed air in which oil has been injected is supplied via each of the branches.

In some cases, in particular when there are three branches, it may be advisable that the compressed air in one branch does not contain any lubricant.

In the known line lubricators, this is solved by means of a by-pass bridging the head, which makes the construction complicated and expensive.

SUMMARY OF THE INVENTION

The present invention aims a device for injecting liquid in a compressed gas which avoids the above-mentioned disadvantage and which has a relatively simple construction, but which can nevertheless supply gas both with and without any injected liquid.

This aim is realized according to the invention in that the passage, seen in the flow direction, is divided in two separate gas channels by means of a wall, from before the place where the liquid enters the passage up to the end of the passage, such that the liquid only enters in one of the two gas channels.

When a nozzle with two or more branches, either or not equipped with a closure valve, is connected to the end of the passage situated downstream, one or more branches are connected to one of the gas channels from which flows gas without liquid, whereas the other branches are connected to the other gas channel from which flows gas with injected liquid.

The above-mentioned wall can be entirely or partly fixed to a nozzle which is mounted on the head and which is provided with couplings for connecting the pipes with gas under pressure and possibly also closure valves, but said wall is preferably fixed directly to the head itself.

The wall may form a tube at least at the end of the passage, which is preferably coaxial to the passage, whereby the one gas channel, preferably the gas channel for gas without liquid, is then limited by this tube.

A part of the passage itself may form the above-mentioned tube, in which case the liquid channel can open directly in the passage.

However, the above-mentioned jet pipe may also be erected inside the passage, in which case the liquid channel opens in the vacuous part of this internal jet pipe and the liquid enters the passage via said jet pipe.

In the latter case, the place where the liquid enters the passage is the outlet of the internal jet pipe, and the wall extends in the flow direction from before this outlet of this jet pipe up to the end of the passage.

With an internal jet pipe, the head can be provided with what is called a double jet pipe, whereby a part of the passage thus forms a part of a first jet pipe and the internal jet pipe forms a second one which is erected inside the first one and which is usually coaxial to the first one. Such a double nozzle pipe allows for a larger discharge head of the liquid.

Especially in these cases with an internal jet pipe, it is unusual to provide a wall in the passage, since the internal jet pipe on first thoughts seems to obstruct such a jet pipe.

However, it was found that this was possible by providing the beginning of the wall next to the internal jet pipe.

This wall may for example consist of a plate-shaped part which begins between the bent side of the passage and the internal jet pipe and which continues along this side and is transformed in a tube-forming part via a transition part, whereby the space between this plate-shaped part and the side of the passage on the one hand, and the inside of the tube-forming part on the other hand are part of one of the gas channels.

BRIEF DESCRIPTION OF THE DRAWINGS

In order to better explain the characteristics of the invention, the following preferred embodiments of a device according to the invention for injecting a liquid in a compressed gas are represented as an example only without being limitative in any way, with reference to the accompanying drawings, in which:

FIG. 3 shows a vertical section of the device from

FIG. 2, drawn to a larger scale;

FIG. 4 shows a section according to line IV—IV in

FIG. 2, drawn to the same scale as in FIG. 3.

DESCRIPTION OF THE PREFERRED EMBODIMENTS

Figure 1:
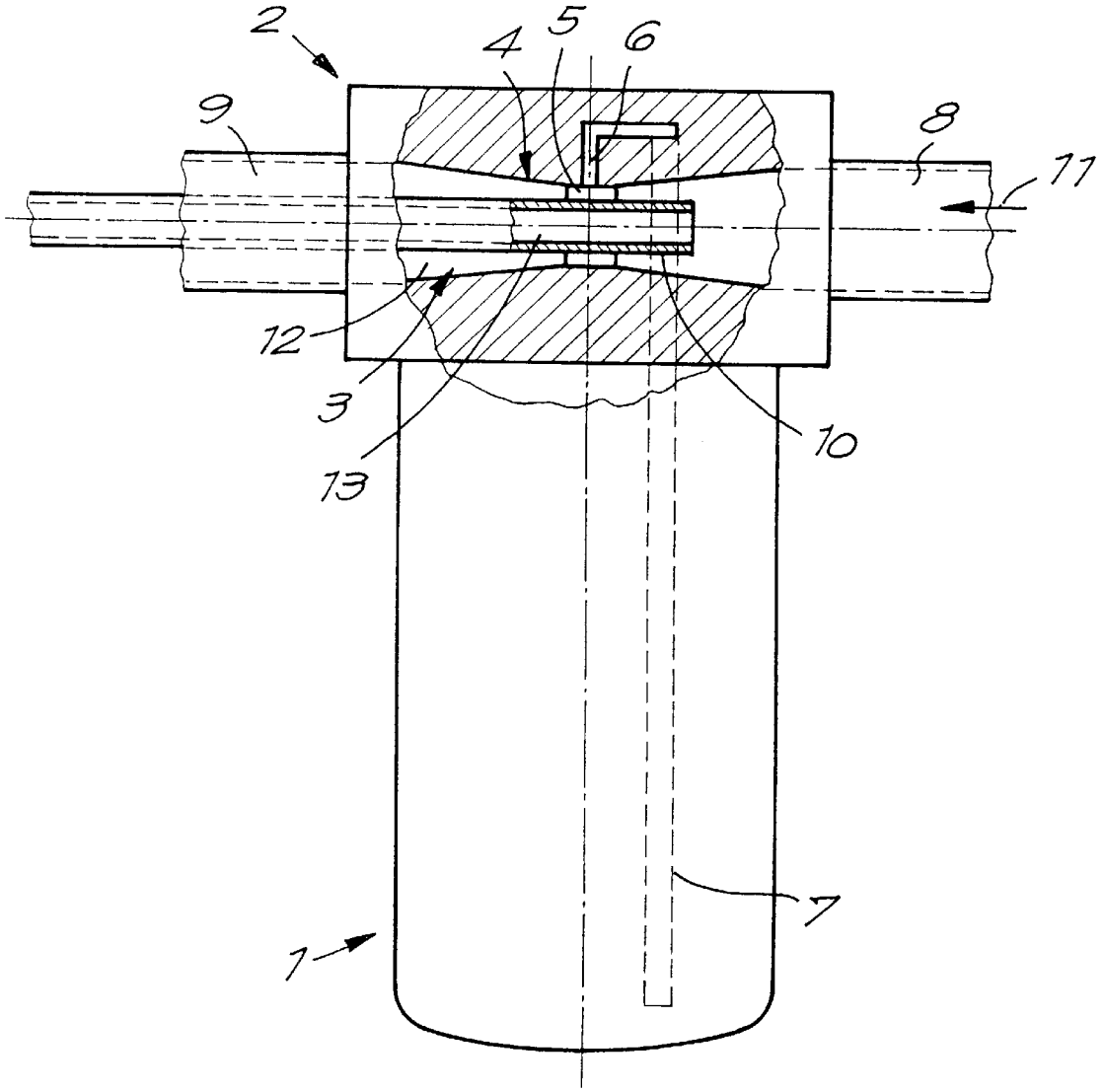
FIG. 1 schematically represents a section of a device for injecting a liquid in a compressed gas according to the invention.

The device for injecting a liquid in a compressed gas which is schematically represented in FIG. 1 mainly consists of a standing reservoir 1 for liquid which is open at the top and of a cover 2 sealing off the top of this reservoir 1 and which is provided with a passage 3 which itself forms a single jet pipe 4 and which thus has a part which narrows/widens locally.

In the throat of this jet pipe 4, i.e. there the passage 3 is the narrowest, in other words in the vacuous part 5 of this jet pipe 4, a liquid channel 6 opens which is connected to the inside of the reservoir 1, for example by means of a little tube 7 which reaches up to the bottom of the reservoir 1. In this liquid channel 6 may be provided a discharge regulator.

On either side of this part forming the jet pipe 4, the cover 2 has connecting pieces 8 and 9 whose cylindrical openings form parts of the passage 3 which are connected to the ends of the jet pipe 4.

What is characteristic is that a wall 10 is provided in the passage 3 which extends, as seen in the flow direction indicated by the arrow 11, from before the discharge of the liquid channel 6 in the passage 3 up to or past the end of this passage 3, and which divides this passage 3 in two separate gas channels 12 and 13.

In the given example, the wall 10 is a round tube which is erected axially in the passage 3 and which protrudes somewhat outside the connecting piece 9. Thus, the one gas channel 13 is situated inside this tube, whereas the other gas channel 12 is situated between this tube and the wall of the passage 3.

The wall 10 is fixed to the cover 2, in particular to the connecting piece 9, for example by means of one or several radially directed connections which are not represented in the figure.

Such a device can be connected to the inside of a receiver with gas under pressure with the one connecting piece 8, and, with the other connecting piece 9, to a network of the user, containing a first pipe for gas under pressure which is connected to the gas channel 12 and a second pipe for gas under pressure which is connected to the gas channel 13.

When these pipes are open, gas under pressure flows from the receiver through the passage 3. There where the wall 10 begins, the gas flow is split in two, whereby one part goes through the gas channel 12 and thus past the discharge of the liquid channel 6, and the other part goes through the gas channel 13.

As the top side of the reservoir 1 is connected to the inlet of the passage 3 via an opening which is not represented in FIG. 1, the compressed gas will exert some pressure on the liquid in the cistern 1. Thanks to the a suction in the vacuous part 5, liquid will be sucked from the reservoir 1 via the little tube 7 and the liquid channel 6, and it will end up in the gas flowing in the gas channel 12.

No liquid is added to the part of the gas flowing through the gas channel 13.

At the outlet of the passage 3, both gas with injected liquid and gas containing no liquid is available.

The connecting piece 9 may be equipped with a nozzle provided with branches which may possibly be shut off by closure valves, such that one or both gas channels 12 and 13 can be connected to more than one pipe of the network.

In this case, according to a variant, the wall 10 can be supported by this nozzle instead of by the cover 2.

Figure 2:
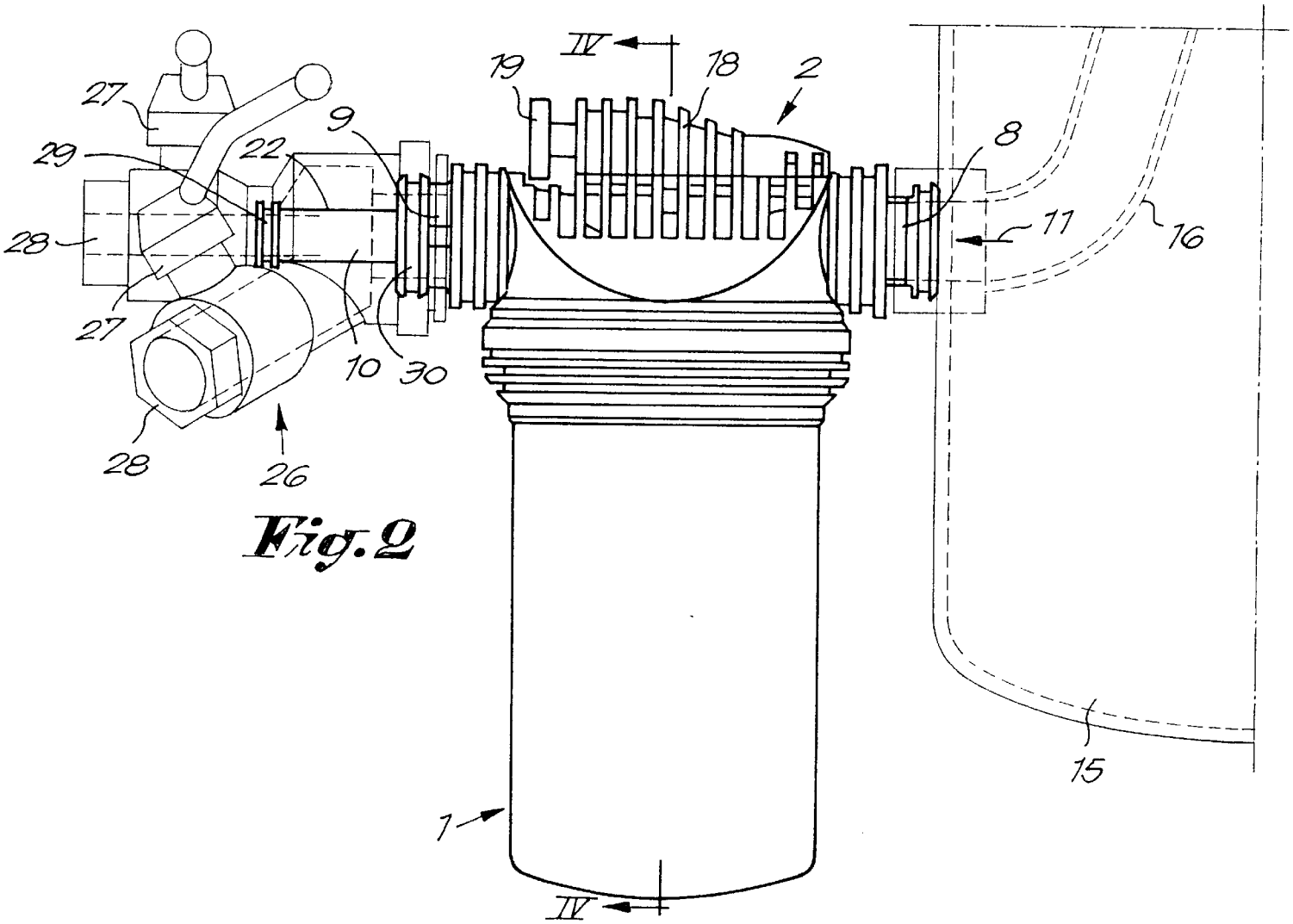
FIG. 2 shows a side view of another embodiment of the device according to the invention.
Figure 3:
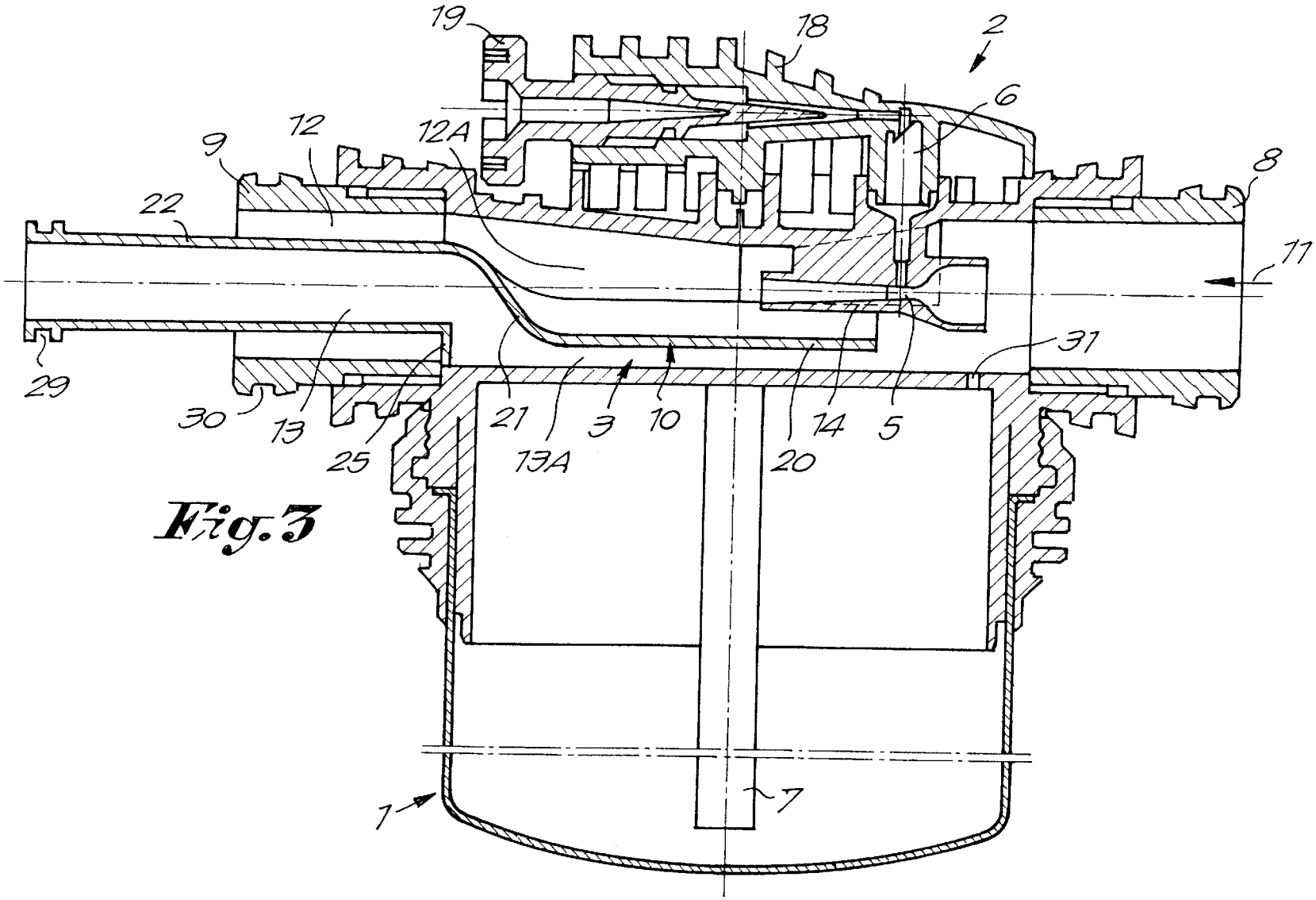
Figure 4:
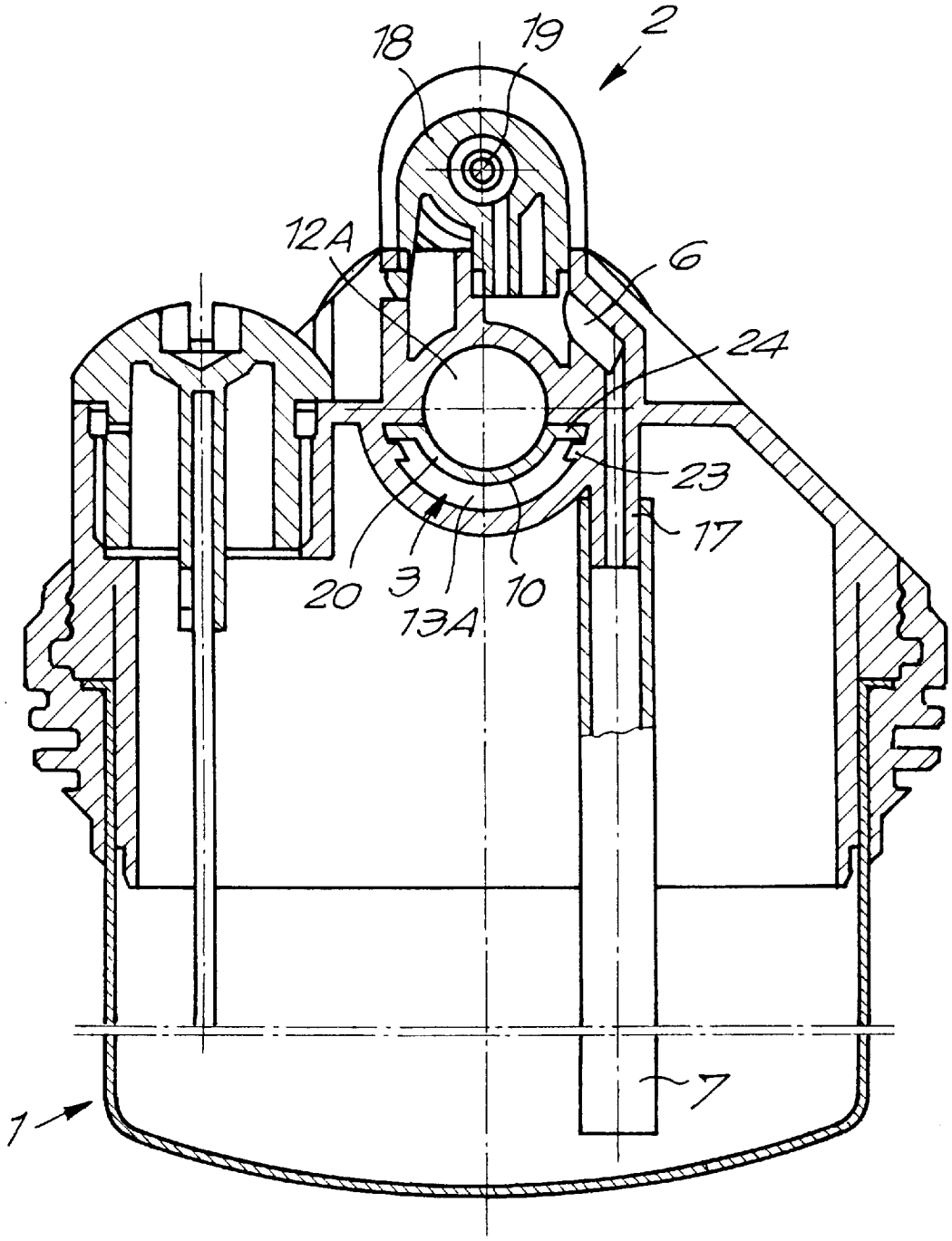

FIGS. 2 to 4 represent a more practical embodiment of a device according to the invention for injecting lubricating oil in compressed air.

This embodiment mainly differs from the above-described embodiment in that the cover 2 is provided with a double jet pipe and thus the passage 3 itself forms at least a part of an external jet pipe on the one hand, and in that an internal jet pipe 14 is erected in this passage 3 on the other hand, whereby the wall 10 extends with a part next to this internal jet pipe 14.

The internal jet pipe 14 forms a second jet pipe which is situated inside the first external jet pipe, so that the head 2 is of the type with a double jet pipe or venturi tube.

The outlet of the internal jet pipe 14 is situated more or less near the throat or near the vacuous part of the above-mentioned external jet pipe.

This internal jet pipe 14 is fixed to the top side of the wall of the passage 3.

The beginning of the passage 3, between the connecting part and the wall 10, is connected to the top side of the cistern 1 via an opening 31.

The connecting piece 8 is connected to a pipe 16 which opens on the top side of the compressed air receiver 15.

The liquid channel 6 opens into the throat of the vacuous part 5 of the jet pipe 14.

This liquid channel 6 hereby extends as of a small pipe 17 onto which the little tube 7 is clasped, via the wall of the passage 3 into the body 18 of a discharge control part on top of the passage 3 to subsequently open into the jet pipe 14 via the top side.

Inside this body 18, the liquid channel 6 may have a conical part in which the conical point of an adjusting screw 19 is situated which is screwed in this body 18.

The wall 10 consists of a plate-shaped part 20 which is transformed into a tube-forming part 22 via a transition part 21.

The plate-shaped part 20 begins, in the direction represented by the arrow 11, in front of the discharge of the above-mentioned jet pipe 14 in the passage 3.

This plate-shaped part 20 divides a part of the passage 3 in two spaces extending in the longitudinal direction which are situated on top of and under this plate-shaped part 20 respectively in FIGS. 2 to 4, namely a space 12A which is part of the gas channel 12 and in which the jet pipe 14 opens, and a part 13A which is part of the gas channel 13.

Up to near the connecting piece 9, the part 20 of the wall 10 is bent and almost concentric to the lower cylindrically bent half of the inner side of the passage 3, whereas, with each of its longitudinal edges, it is pushed between an edge 23 standing on the above-mentioned inner side of the passage 3 and a collar 24 which is formed as the top half of this inner side is bent with a smaller radius than the lower half, although this radius increases in the direction of the arrow 11.

The tube-forming part 22 is situated axially in the connecting piece 9, it rests on the bottom side of the passage 3 with its front end by means of an edge 25 and it protrudes outside this connecting piece 9 with its end.

Over this last-mentioned end of the part 22 and over the connecting piece 9 is provided a nozzle 26 with three branches which can be shut off by means of closure valves 27, which for clarity's sake is only represented in FIG. 2, and with which the device is connected onto the network of the user.

Each branch is provided with a coupling 28 to connect a compressed air line from the network with this branch.

This nozzle 26 is mounted on the cover 2 by means of screws, whereby one of the three branches fits around the part 22 thanks to a sealing ring in a groove 29 of this part 22, whereas the outside of the nozzle 26 fits up around the connecting piece 9 thanks to a sealing ring which is situated in a groove 30 in this connecting piece 9.

This means that the first-mentioned branch is connected to the gas channel 13 and that the space of the nozzle 26 situated around this branch onto which the other branches open is connected to the gas channel 12.

The working is analogous to that of the embodiment according to FIG. 1, with this difference that the oil is now sucked in via the liquid channel 6 via the jet pipe 14, and ends up in the passage 3, in particular the gas channel 12, together with the part of the compressed air flowing through this jet pipe 14.

In the branch which is connected to this gas channel 13 is supplied compressed air containing no oil , whereas air with injected oil can be obtained in the other branches which are connected to the gas channel 12, whereby the oil flow can be adjusted by turning the adjusting screw 19.

As the jet pipe 14 is erected inside an external jet pipe and opens into the throat of this external jet pipe, a larger a suction can be created on the outlet of the jet pipe 14, and thus a larger discharge head of the oil becomes available.

The invention is by no means restricted to the embodiments described above and represented in the accompanying drawings; on the contrary, such a device for injecting liquid in a gas under pressure can be made in all sorts of variants while still remaining within the scope of the invention.

What is claimed is:

1. A device for injecting a liquid in a compressed gas comprising a reservoir for the liquid and a cover being sealed onto said reservoir;

said cover comprising a passage for the gas having an opening to a liquid channel connected to the reservoir;

said passage being arranged with an internal jet pipe having a vacuous portion wherein said liquid channel discharges the liquid, and in the flow direction said passage is divided into two separate gas channels by a wall;

said wall extending from before the liquid channel to at least an end of said passage, such that the liquid only enters in one of said two gas channels; and wherein by creating said two gas channels, said device supplies gas both with and without an injected liquid at the same instance.

2. The device according to claim 1, wherein said wall comprises a channel and is fixed to a nozzle and is mounted onto said cover and is provided with couplings for connecting said channel to pipes with gas under pressure.

3. The device according to claim 1, wherein said wall is fixed to the cover.

4. The device according to claim 1, wherein said wall forms a pipe at least at the end of said passage and said pipe extends coaxial to said passage.

5. The device according to claim 1, wherein a portion of said passage forms said jet pipe and said liquid channel opens directly into said portion of said passage.

6. The device according to claim 1, wherein said jet pipe is disposed within the passage, such that the liquid channel opens in the vacuous portion of said jet pipe wherein the liquid enters the passage at an outlet of the jet pipe, said wall extending in the flow direction from before the outlet of the jet pipe up to the end of the passage.

7. The device according to claim 6, wherein said cover comprises a double jet pipe, such that a portion of the passage forms at least a portion of a first jet pipe and the internal jet pipe forms a second jet pipe disposed within said first jet pipe.

8. The device according to claim 6, wherein said wall comprises a plate-shaped part situated between an inner side of the passage and the internal jet pipe, said plate-shaped part continuing along the inner side of the passage and transforming into a tube-forming portion via a transition part, such that a portion of a gas channel is formed by a conduit bounded by said plate-shaped part and said inner side of the passage.

9. The device according to claim 8, wherein a portion of the plate-shaped part is concentric to the passage;

said plate-shaped part having longitudinal edges wherein the longitudinal edges are inserted between a top side of the passage and a collar protruding from a top portion of said inner side of the passage; and said gas channel having a curved cross-section having a radius of curvature that increases progressively as said channel approaches to at least the end of the passage.

* * * * *